US008939521B2

(12) United States Patent
Barenbrugge

(10) Patent No.: US 8,939,521 B2
(45) Date of Patent: Jan. 27, 2015

(54) SHELF GAP SPACER DEVICE FOR A MERCHANDISE DISPLAY SYSTEM

(71) Applicant: RTC Industries, Inc., Rolling Meadows, IL (US)

(72) Inventor: Joel Barenbrugge, Naperville, IL (US)

(73) Assignee: RTC Industries, Inc., Rolling Meadows, IL (US)

( * ) Notice: Subject to any disclaimer, the term of this patent is extended or adjusted under 35 U.S.C. 154(b) by 78 days.

(21) Appl. No.: 13/847,851

(22) Filed: Mar. 20, 2013

(65) Prior Publication Data

US 2013/0248476 A1 Sep. 26, 2013

Related U.S. Application Data

(60) Provisional application No. 61/613,463, filed on Mar. 20, 2012.

(51) Int. Cl.
*A47B 96/18* (2006.01)
*A47F 5/00* (2006.01)
(Continued)

(52) U.S. Cl.
CPC ..... *A47F 5/00* (2013.01); *A47B 95/043* (2013.01); *A47F 5/005* (2013.01); *A47B 77/022* (2013.01); *A47F 5/103* (2013.01); *A47F 13/00* (2013.01); *A47B 97/00* (2013.01); *A47B 96/02* (2013.01)
USPC ..... 312/140.4; 211/183; 297/182; 108/27

(58) Field of Classification Search
CPC ..... A47F 5/103; A47F 13/00; A47F 5/00; A47F 5/005; A47F 2005/0075; A47F 9/00; A47F 2010/065; A47B 95/043; A47B 96/201; A47B 77/022; A47B 13/083; A47B 2095/046; A47B 97/00; A47B 2077/027; A47B 96/02; A47B 96/18; A47B 17/00; A47D 15/00
USPC ..... 211/134, 183, 57.1, 184; 312/140.4, 312/140.1; 108/90, 27; 52/287.1, 461, 459, 52/471, 716.1, 716.2, 716.3; 297/182
See application file for complete search history.

(56) References Cited

U.S. PATENT DOCUMENTS 2,705,820 A * 4/1955 Torrence ..... 52/782.2
2,888,684 A * 6/1959 Icenhower ..... 52/716.1
(Continued)

FOREIGN PATENT DOCUMENTS

CA 2228085 7/1999
EP 0527658 2/1993
(Continued)

OTHER PUBLICATIONS

International Search Report and Written Opinion from International PCT Application No. PCT/US2013/033143 dated Nov. 20, 2013.
(Continued)

*Primary Examiner* — Jennifer E Novosad
(74) *Attorney, Agent, or Firm* — Banner & Witcoff, Ltd.

(57) ABSTRACT

Aspects of the disclosure relate to a spacer device for use with a merchandise display. The merchandise display may include a first upright and a second upright opposite the first upright, a pegboard mounted between the two uprights, and at least one shelf mounted to the two uprights, wherein the configuration includes a gap between a back of the shelf and the pegboard. The spacer device may include two opposing ends. Each of the opposing ends may include a support arm that extends downward towards the gap, a mounting arm that extends downward towards the gap, and a tab that projects outward and away from the mounting arm. The spacer device may also include a gap filler portion extending between the two opposing ends wherein when the device is secured in the gap, the gap filler portion fills the gap.

20 Claims, 10 Drawing Sheets

(51) Int. Cl.

| | |
|---|---|
| ***A47D 15/00*** | (2006.01) |
| ***A47B 17/00*** | (2006.01) |
| ***A47B 95/04*** | (2006.01) |
| ***A47B 77/02*** | (2006.01) |
| ***A47F 5/10*** | (2006.01) |
| ***A47F 13/00*** | (2006.01) |
| ***A47B 97/00*** | (2006.01) |
| *A47B 96/02* | (2006.01) |

(56) References Cited

U.S. PATENT DOCUMENTS

| | | | | |
|---|---|---|---|---|
| 2,981,580 | A * | 4/1961 | Hansen | 108/27 |
| 3,007,213 | A * | 11/1961 | Hobbs | 52/287.1 |
| 3,249,628 | A | 2/1969 | Laszio | |
| 3,446,201 | A * | 5/1969 | More | 126/39 R |
| 3,667,177 | A * | 6/1972 | Biela | 52/278 |
| 4,308,309 | A * | 12/1981 | Frosch et al. | 428/193 |
| 4,385,850 | A * | 5/1983 | Bobath | 403/205 |
| 4,858,413 | A * | 8/1989 | Grushka | 108/27 |
| 5,181,357 | A * | 1/1993 | Pourtau et al. | 52/179 |
| 5,429,844 | A * | 7/1995 | Galardi | 428/31 |
| 5,470,422 | A * | 11/1995 | Gold | 156/108 |
| 5,516,185 | A * | 5/1996 | O'Donnell et al. | 296/166 |
| 5,518,309 | A * | 5/1996 | St-Pierre | 312/140.4 |
| 5,678,380 | A * | 10/1997 | Azzar | 52/716.4 |
| 5,733,022 | A * | 3/1998 | Whetstone | 312/140.4 |
| 6,115,982 | A * | 9/2000 | Lindenberg | 52/506.05 |
| 6,135,581 | A * | 10/2000 | Kopp et al. | 312/140.3 |
| 6,188,527 | B1 | 2/2001 | Bohn | |
| 6,283,612 | B1 | 9/2001 | Hunter | |
| D464,162 | S | 10/2002 | Segretto | |
| 6,536,924 | B2 | 3/2003 | Segretto | |
| 6,736,525 | B2 | 5/2004 | Chin | |
| D496,122 | S | 9/2004 | Kan | |
| D506,274 | S | 6/2005 | Moriyama et al. | |
| 6,995,405 | B2 | 2/2006 | Braddell et al. | |
| 6,997,576 | B1 | 2/2006 | Lodhie et al. | |
| 7,140,206 | B2 * | 11/2006 | Braun et al. | 68/3 R |
| 7,150,166 | B2 * | 12/2006 | Braun et al. | 68/3 R |
| D546,985 | S | 7/2007 | Hoshikawa et al. | |
| D550,379 | S | 9/2007 | Hoshikawa et al. | |
| D550,869 | S | 9/2007 | Hoshikawa et al. | |
| D565,515 | S | 4/2008 | Chen | |
| D568,500 | S | 5/2008 | Uemoto et al. | |
| D571,938 | S | 6/2008 | Uemoto et al. | |
| D578,681 | S | 10/2008 | Huang | |
| D579,138 | S | 10/2008 | Ghini | |
| 7,441,922 | B2 | 10/2008 | Huang et al. | |
| D581,569 | S | 11/2008 | Levine | |
| D595,444 | S | 6/2009 | Shimomura | |
| D603,079 | S | 10/2009 | Toot et al. | |
| D606,673 | S | 12/2009 | Kao | |
| 7,648,251 | B2 | 1/2010 | Whitehouse et al. | |
| 7,674,010 | B2 | 3/2010 | Griffiths et al. | |
| D614,323 | S | 4/2010 | Stewart et al. | |
| D615,223 | S | 5/2010 | Huang | |
| 7,722,221 | B2 | 5/2010 | Chae | |
| 7,736,711 | B2 * | 6/2010 | Dobelle | 428/34.1 |
| 7,784,238 | B2 * | 8/2010 | Bannister | 52/465 |
| 7,824,057 | B2 | 11/2010 | Shibusawa et al. | |
| 8,066,406 | B2 | 11/2011 | Boyer et al. | |
| 8,070,329 | B1 | 12/2011 | Bechtel et al. | |
| 8,196,931 | B2 * | 6/2012 | Burgess | 277/312 |
| 8,215,795 | B2 | 7/2012 | Pichel | |
| 8,522,771 | B2 * | 9/2013 | Mcconnell et al. | 126/500 |
| 2002/0044456 | A1 | 4/2002 | Balestriero et al. | |
| 2003/0020378 | A1 * | 1/2003 | LaChance et al. | 312/140.3 |
| 2005/0265019 | A1 | 12/2005 | Sommers et al. | |
| 2006/0000148 | A1 | 1/2006 | Mugishima et al. | |
| 2006/0146531 | A1 | 7/2006 | Reo et al. | |
| 2007/0267375 | A1 | 11/2007 | Battaglia, et al. | |
| 2008/0094824 | A1 | 4/2008 | Stack et al. | |
| 2008/0094837 | A1 | 4/2008 | Dobbins et al. | |
| 2009/0207602 | A1 | 8/2009 | Reed et al. | |
| 2009/0323330 | A1 | 12/2009 | Gordin et al. | |

FOREIGN PATENT DOCUMENTS

| | | |
|---|---|---|
| EP | 0922596 | 6/1999 |
| GB | 2096060 | 10/1982 |
| GB | 2429911 | 3/2007 |
| JP | H11336208 | 12/1999 |
| JP | 2004337471 | 12/2004 |

OTHER PUBLICATIONS

Final Office Action from U.S. Appl. No. 12/955,198; dated Oct. 16, 2012.

Non Final Office Action from U.S. Appl. No. 12/955,198; dated May 24, 2011.

* cited by examiner

SHELF GAP SPACER DEVICE FOR A MERCHANDISE DISPLAY SYSTEM

CROSS REFERENCE TO RELATED APPLICATIONS

This Application is a non-provisional application to and claims priority to U.S. Provisional Application Ser. No. 61/613,463, filed Mar. 20, 2012.

FIELD OF INVENTION

This invention relates generally to devices for use with shelving systems and merchandise display systems. In particular, in one aspect of the invention, a gap spacer device is provided for use with a shelving system, wherein, when installed on the shelving system and/or merchandise display systems, the gap spacer device blocks product from falling down a gap created between a shelf and a pegboard of the shelving system.

BACKGROUND

Many retail stores use a merchandise display system that includes a shelving system where a gap exists behind the shelves on an island gondola used in the retail store. An island gondola is essentially a two-sided gondola, which is most often located at the aisles at most grocery, drug, and mass merchant type stores. One side of the gondola faces the aisle the consumer is in and the other side of the gondola faces the aisle adjacent to the consumer. Generally, the gondola consists of a pair of uprights, a shelving system and, either one or two separate pieces of pegboard. When two pieces of pegboard are used, one piece of pegboard faces one aisle and the other piece of pegboard faces the adjacent aisle. When one piece of pegboard is used, there is only one means of mounting of peg hooks. The peg hooks installed on one side will be seen on the other side. Additionally, the peg hooks mounted on one side cannot share the same mounting holes with a peg hook on the other side.

The uprights of the gondola stand proud of the pegboard and are essentially the same depth throughout the industry—generally the depth of approximately a two-piece pegboard. One pegboard may be utilized and installed in the uprights of the gondola. When a shelf is then installed in the upright, the back of the shelf may fall short of the pegboard itself, thereby creating a gap, as illustrated in FIG. 1. This gap may vary, depending on the manufacturer of the pegboards and/or uprights. This gap has been found to vary from approximately 1 inch to 3 inches. This gap thereby allows products of that size or smaller to fall off the back of the shelf, often all the way down to the base deck or base shelf. When inventories are done, the product may be missing from the shelf, does not get sold, does not get counted, and usually then is perceived stolen. This may cause a large potential for lost revenue.

In one exemplary aspect of the present invention, this gap is filled by a device that can be simply installed into the shelving system to ensure that no product falls through the gap.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

One exemplary embodiment includes a device for use with a shelving system that defines a gap between a single pegboard and a shelf. The device may include a first end and a second end and a gap filler portion located between the first end and the second end, wherein the first end and the second end include a support arm and a mounting arm extending downward towards the gap, wherein the mounting arm includes flared projections configured to engage a back of a shelf to secure and lock the device in the gap, wherein when the device is secured in the gap, the gap filler portion is configured to fill the gap. The gap filler portion may include a plurality of teeth extending upward and configured to engage with the pegboard. The plurality of teeth may flex and be configured to receive a peg hook mounted on the pegboard.

Another exemplary embodiment may include a device for use with a shelving system that defines a gap between a pegboard and a shelf. The device may comprise two opposing ends, wherein each of the opposing ends includes a support arm and a mounting arm configured to extend downward towards the gap; and a gap filler portion extending between the two opposing ends and located between the two opposing ends. The mounting arms may be configured to engage a back of a shelf to secure and lock the device in the gap. The support arms may be configured to flex against a pegboard providing biasing pressure against the pegboard, and wherein when the device is secured in the gap, the gap filler portion is configured to fill the gap.

Another exemplary embodiment may include a shelving system for merchandise that may comprise a first upright and a second upright opposite the first upright; at least one pegboard mounted to and between the first upright and the second upright; at least one shelf mounted to the first upright and the second upright, thereby spanning the entire length of the pegboard between the first upright and the second upright, wherein the configuration includes a gap between a back of the shelf and the pegboard; and a gap spacer device extending between the first upright and the second upright, wherein when installed in the shelving system, the gap spacer device fills the gap and is configured to prevent or block merchandise from falling between the gap. The gap spacer device may include two opposing ends, wherein each of the opposing ends engage and mount between shelf and the pegboard, thereby locking the gap spacer device in the gap; and a gap filler portion extending between the two opposing ends and located between the two opposing ends, wherein when the gap spacer device is secured in the gap, the gap filler portion covers the gap.

Another exemplary embodiment may include a spacer device for use with a merchandise display that includes a first upright and a second upright opposite the first upright, a pegboard mounted to and between the first upright and the second upright, and at least one shelf mounted to the first upright and the second upright, thereby spanning the entire length of the pegboard between the first upright and the second upright, wherein the configuration includes a gap between a back of the shelf and the pegboard. The spacer device may comprise two opposing ends, wherein each of the opposing ends includes a support arm that extends downward towards the gap, a mounting arm that extends downward towards the gap, and a tab that projects outward and away from the mounting arm; a gap filler portion extending between the two opposing ends and located between the two opposing ends; and a shelf lip projecting outward from the gap filler portion and away from the pegboard, wherein the shelf lip is configured to engage a top of a shelf edge when the device is installed in the merchandise display. The mounting arms include flared projections that may be configured to engage a back of the shelf to secure and lock the device in the gap. The support arms may be configured to flex against the pegboard providing biasing pressure against the pegboard. Furthermore, when the device is secured in the gap, the gap filler portion is configured to fill the gap.

Other objects and features of the invention will become apparent by reference to the following description and drawings.

BRIEF DESCRIPTION OF THE DRAWINGS

A more complete understanding of the present invention and certain advantages thereof may be acquired by referring to the following detailed description in consideration with the accompanying drawings, in which.

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized, and structural and functional modifications may be made without departing from the scope of the present invention. Also, while the terms "top", "bottom", "front", and "back" the like may be used in this specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention.

Figure 1:
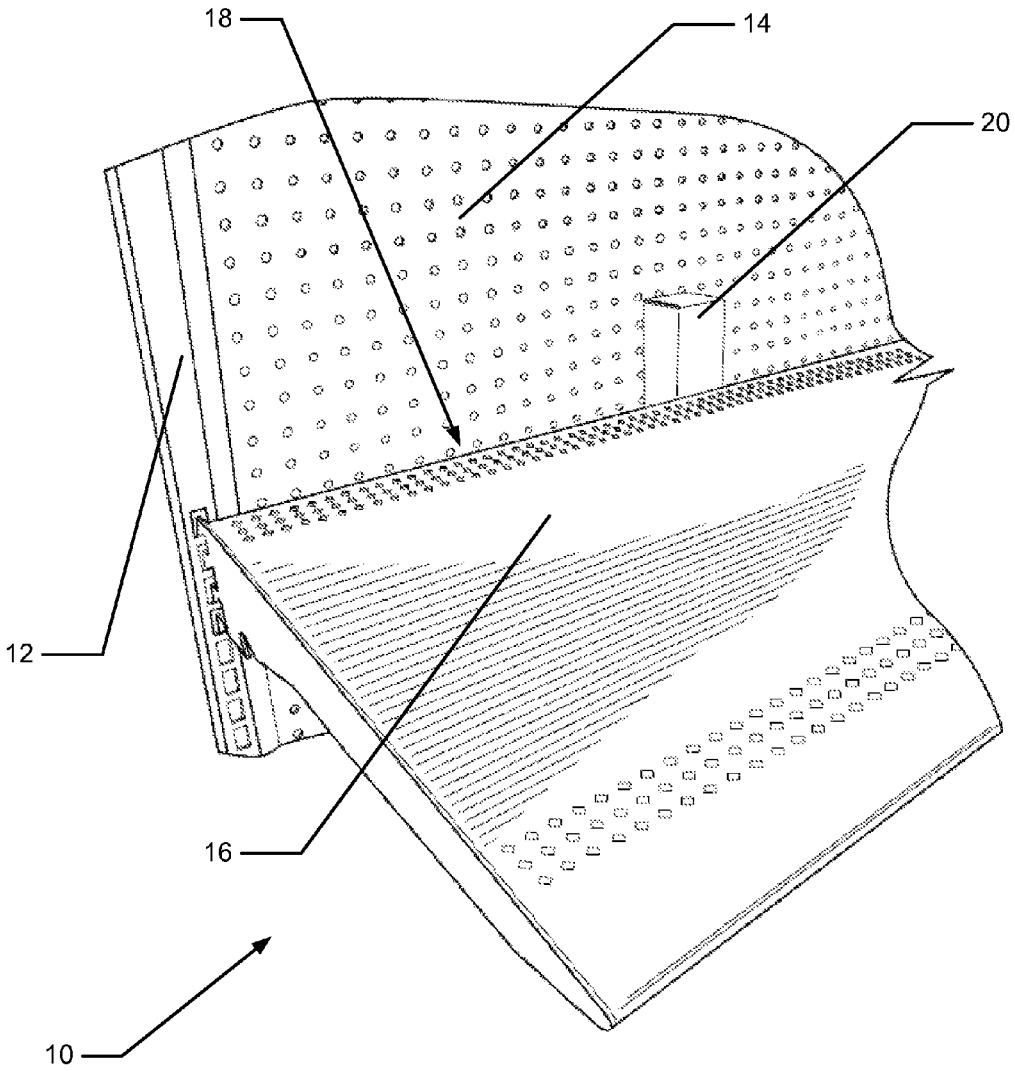
FIG. 1 shows a partial perspective view of an shelving system used in a retail setting in accordance with this invention.

FIG. 1 illustrates an exemplary shelving system 10 as described above and as utilized with the present invention. The shelving system 10 may include two uprights 12. (FIG. 1 shows only one upright 12). The two uprights 12 may stand on their own and provide the shelving system 10 with the standing support. The shelving system 10 may also include a pegboard 14 or multiple pegboards. One or two pegboards 14 may be installed between the two uprights 12. The pegboard 14 may be utilized as a means for mounting peg hooks to hold and display products for the consumer on the shelving system 10. As illustrated in FIG. 1, the pegboard 14 may include a number of holes for the peg hooks to be mounted. Additionally, the shelving system 10 includes a shelf 16. Multiple shelves 16 may be utilized for a given shelving system 10. The shelf 16 may be installed and mounted to the uprights 12, thereby spanning the entire length of the pegboards 14 between the two uprights 12. The shelf 16 may be utilized to hold a product 20 for display and/or purchase for a consumer.

Additionally, because of the configuration of the uprights 12, pegboard 14, and shelf 16, the shelving system 10 may include a gap 18 between back of the shelf 16 and the pegboard 14. The gap 18 may allow products 20 the size of the gap or smaller to fall off the back of the shelf 16. The gap 18 may vary depending on a number of different factors, such as number of pegboards 14 used, pegboard 14 width, shelf 16 width/length, upright 12 design, and other factors associated with the design and/or manufacturers. The gap 18 may vary from approximately 1 inch to approximately 3 inches. Because the gap 18 may vary throughout different shelving systems 10, a device is required to fill various gap distances to thereby prevent or block the product 20 from falling between the gap 18.

FIGS. 2 through 6 illustrate one embodiment of a gap spacer device 100 designed to fill the gap 18 distances to prevent or block the product 20 from falling between the gap 18. The gap spacer device 100 may generally be the length of shelving system 10, spanning from one upright 12 to the other upright 12. The gap spacer device 100, when installed in the shelving system 10, will fill the gap 18 against the pegboard 14 and between the back of the shelf 16. The gap spacer device 100 may be constructed as a one-piece, molded plastic piece. Other suitable constructions and materials may be utilized without departing from this invention. Generally, the gap spacer includes two ends 102 and a center portion or gap filler portion 104 that spans between each of the two ends 102. The gap spacer device 100 will be described in more detail below.

Figure 2:
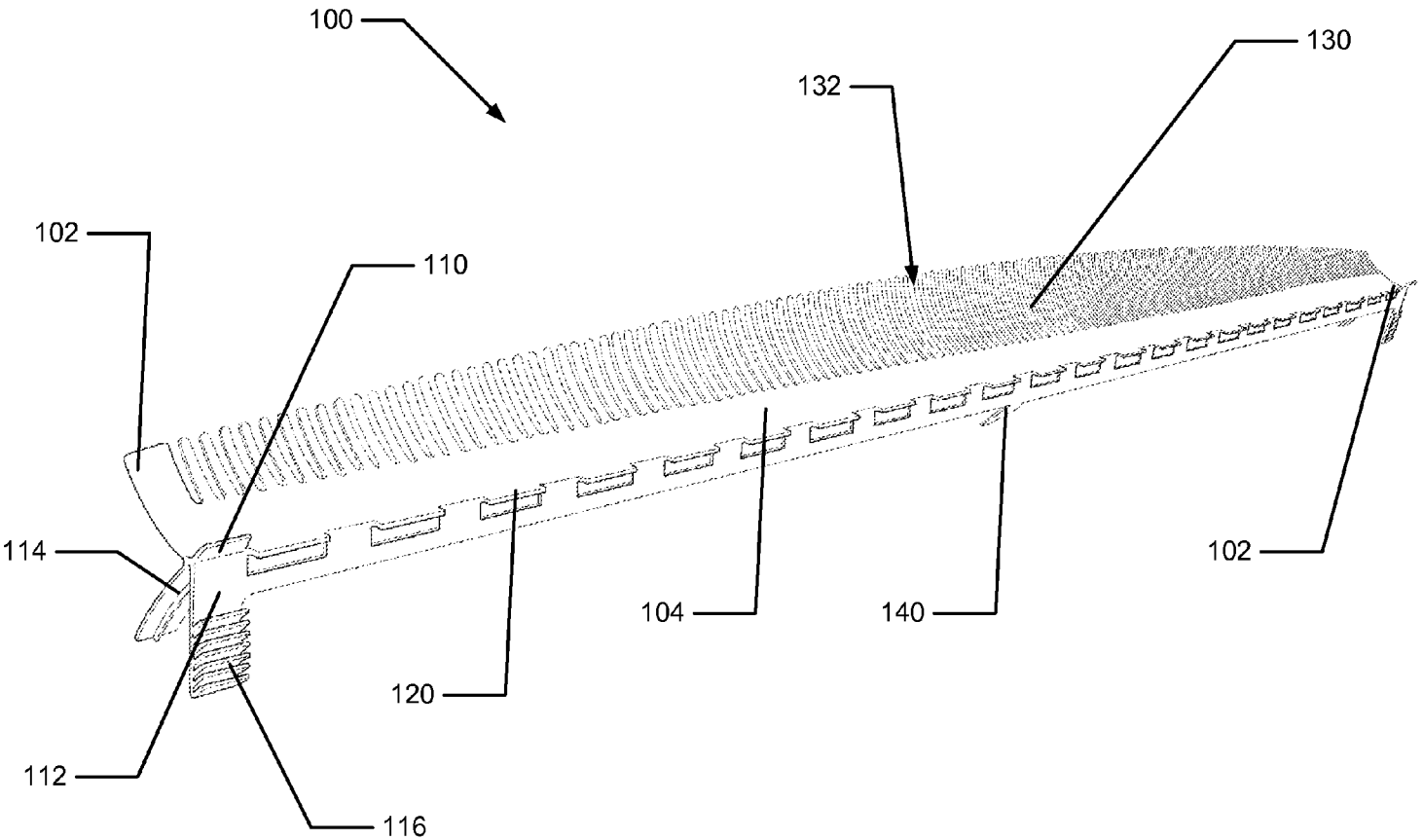
FIG. 2 shows a perspective view of a gap spacer device in accordance with this invention.
Figure 3:
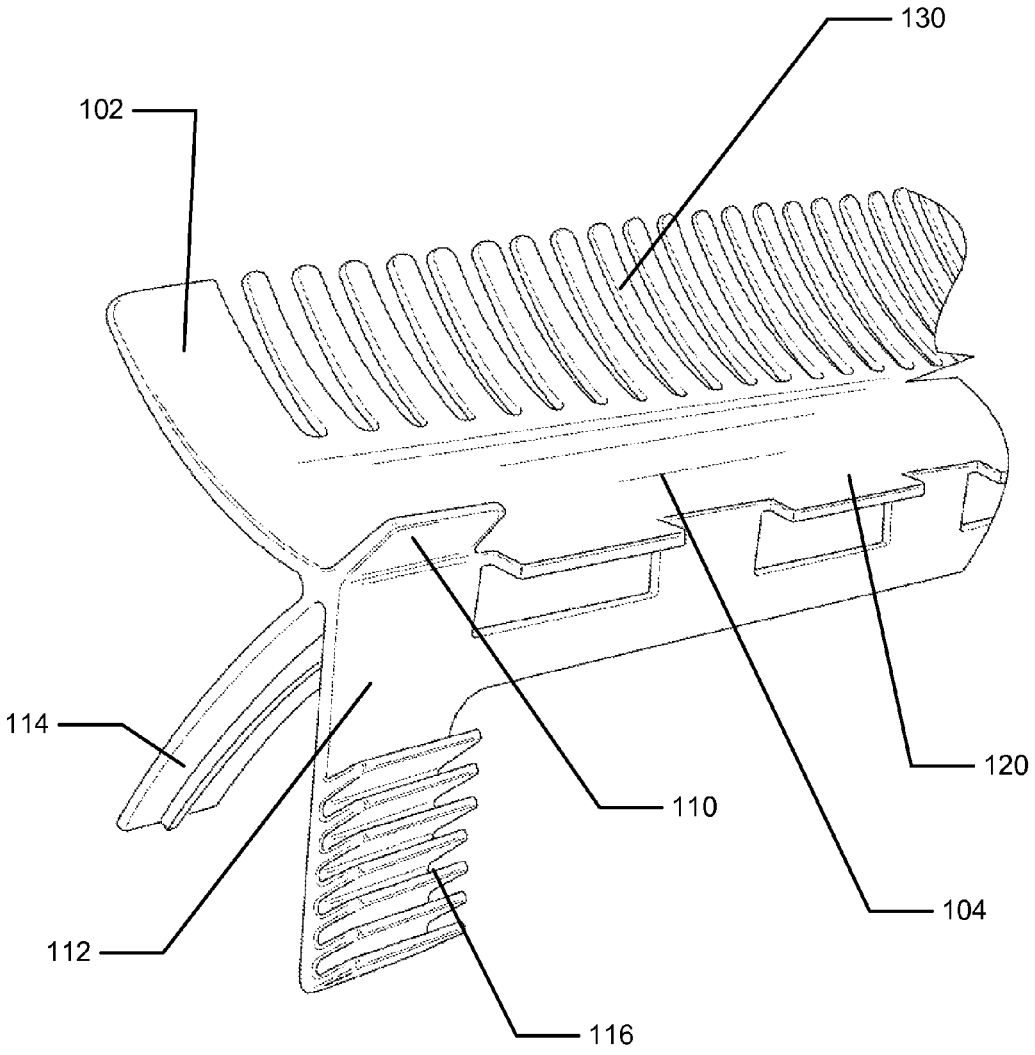
FIG. 3 shows a close-up perspective view of one end of the gap spacer device illustrated in FIG. 2.

As illustrated in FIG. 2, the gap spacer device 100 includes two ends 102. FIG. 3 illustrates a close-up version of one of the ends 102. As illustrated in FIGS. 2 and 3, each end 102 may include a tab 110, a mounting arm 112, and a support arm 114. The tab 110, the mounting arm 112, and the support arm 114 assist with and allow the gap spacer device 100 to be installed and secured to the shelving system 10.

As illustrated in FIGS. 2 and 3, a tab 110 may be located at one or both of the ends 102 of the gap spacer device 100. The tab 110 may project outward and away from the gap spacer device 100 and the gap filler portion 104 and towards a user. The tab 110 may be sized such that a user can use their fingers to grasp onto the tab 110 when holding the gap spacer device 100, installing the gap spacer device 100, and/or removing the gap spacer device 100. The tab 110 may be rectangular as illustrated in FIG. 3 or other shapes without departing from this invention. The purpose of the tab 110 is to allow the user the ability to grasp and hold the gap spacer device 100 during installation and removal from the shelving system 10.

As illustrated in FIGS. 2 and 3, the mounting arm 112 may be located at one or both of the ends 102 of the gap spacer device 100. The mounting arm 112 projects downward away from the gap filler portion 104. The mounting arm 112 may include flared projections 116 located on the front of the mounting arm 112. The flared projections 116 may begin at the bottom of the mounting arm 112 or the end farthest from the tab 110 or gap filler portion 104 and continue towards the tab 110 or gap filler portion 104. The embodiment illustrated in FIG. 3 includes seven flared projections 116, however, the number of flared projections 116 may be varied without departing from this invention. For example, the mounting arm 112 may include five to twenty flared projections 116. The mounting arm 112 may be sized to accommodate the required number of flared projections 116. The mounting arm 112 may be rectangular-shaped as illustrated in FIGS. 2 and 3 or other shapes without departing from this invention. The mounting arm 112 will generally be rigid with very little movement when the gap spacer device 100 is being installed and/or removed from the shelving system 10. However, the mounting arm 112 may slightly flex when the gap spacer device 100 is being installed and/or removed from the shelving system 10.

The purpose of the mounting arm 112 is to secure the gap spacer device 100 into the back of the shelf 16, thereby locking the gap spacer device 100 into the shelving system 10. The flared projections 116 may lock into the back of the shelf 16. The varied number of flared projections 116 may allow the flared projections 116 to lock into various shelf 16 backs with different widths. For example, with a relatively thick back of the shelf 16, the first one or two flared projections 116 closest to the end of the mounting arm 112 may be flexed to lock into the back of the shelf 16. Additionally, with a relatively thin back of the shelf 16, the top one or two flared projections 116 farthest away from the end of the mounting arm 112 may be flexed to locking into the back of the shelf 16.

As further illustrated in FIGS. 2 and 3, the gap spacer device 100 also includes a support arm 114. The support arm 114 projects downward away from the gap filler portion 104. The support arm 114 projects downward at a slightly different angle than the mounting arm 112, projecting more towards the back of the gap spacer device 100. The support arm 114 and the mounting arm 112 create an "V" shape extending from the gap spacer device 100. The support arm 114 may be sized to a similar size as the mounting arm 112. The support arm 114 may also be sized to ensure enough bias pressure is present for the gap spacer device 100 to lock into place. The support arm 114 may be rectangular-shaped as illustrated in FIGS. 2 and 3 or other shapes without departing from this invention. The support arm 114 will generally be more flexible or have a similar flexibility to the mounting arm 112 when the gap spacer device 100 is being installed and/or removed from the shelving system 10. The support arm 114 must be flexible enough such that when the gap spacer device 100 is being installed and/or removed from the shelving system 10, the support arm 114 provides enough bias to ensure the mounting arm 112 is able to lock into the back of the shelf 16. However, the support arm 114 may flex against the pegboard 14 when the gap spacer device 100 is being installed and/or removed from the shelving system 10.

The purpose of the support arm 114 is to provide a biasing pressure to allow the gap spacer device 100 to be installed into the gap 18. The biasing pressure also assists with the locking of the gap spacer device 100 into the back of the shelf 16, thereby locking the gap spacer device 100 into the shelving system 10.

Figure 7:
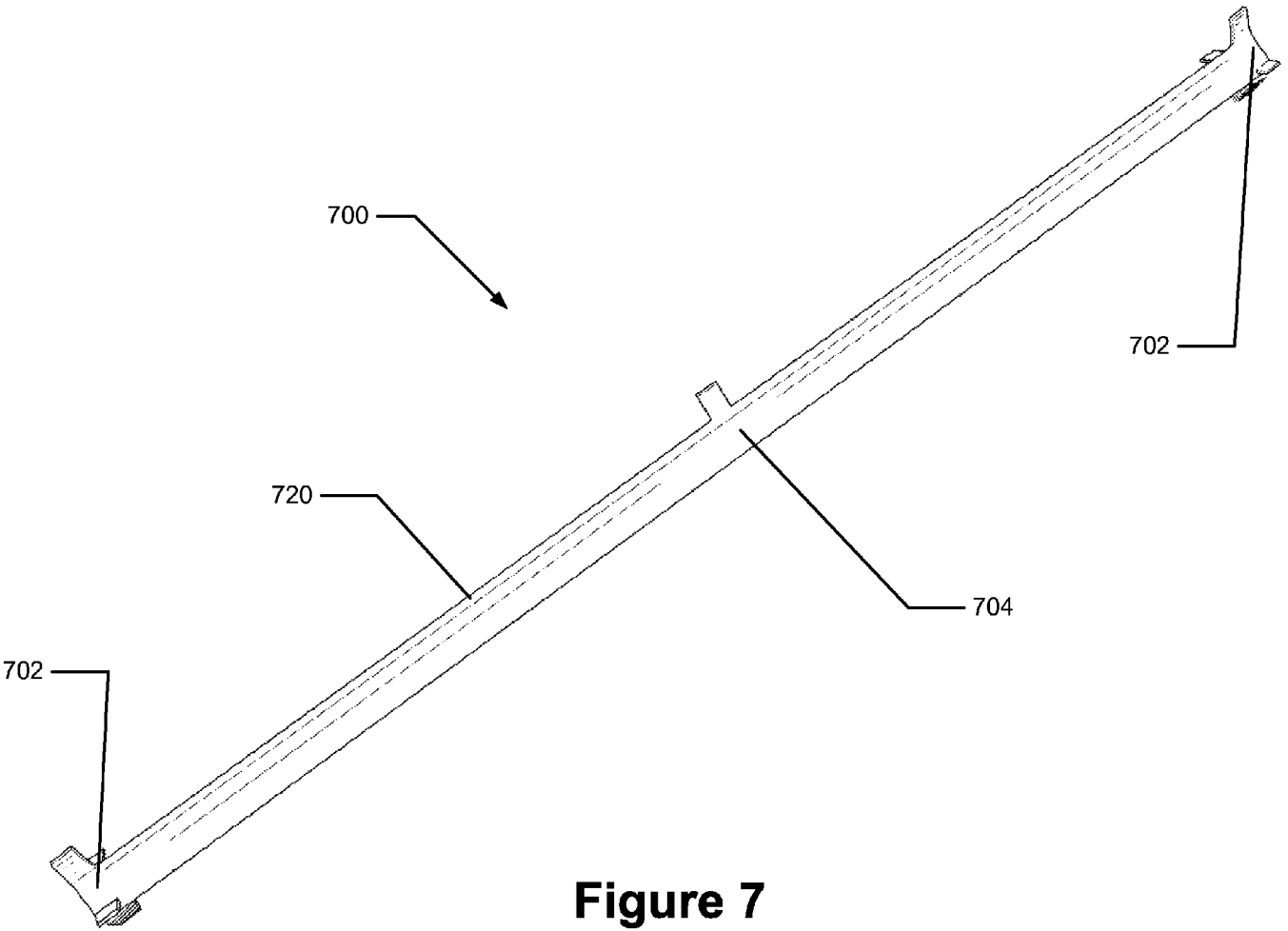
FIG. 7 shows a perspective view of another gap spacer device in accordance with this invention.
Figure 8:
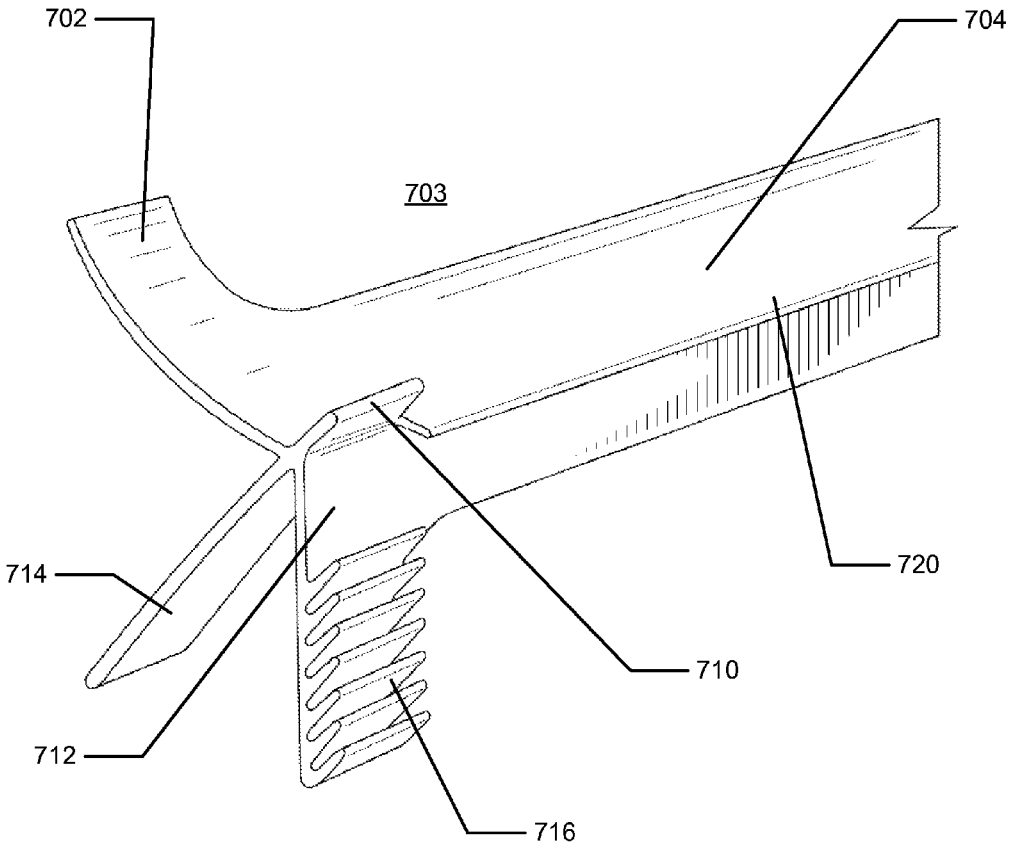
FIG. 8 shows a close-up perspective view of one end of the gap spacer device illustrated in FIG. 7.

Additionally, the gap spacer device 100 may include a shelf lip 120. As illustrated in FIG. 2, the shelf lip 120 may project outward toward the user and away from the pegboard 14. The shelf lip 120 extends out such that the shelf lip 120 rests on or engages the top of the shelf edge 16 when the gap spacer device 100 is installed. As illustrated in FIG. 2, the shelf lip 120 may not be continuous throughout the length of the gap spacer device 100. The shelf lip 120 may be spaced evenly and/or be intermittent through the length of the gap spacer device 100. For example, as illustrated in FIG. 2, the shelf lip 120 extends at various locations evenly along the length of the gap spacer device 100. The shelf lip 120 may be any shape or size as long as the shelf lip 120 engages and maintains the gap spacer device 100 on the shelf 16. The purpose of the shelf lip 120 is to ensure the engagement of the shelf 16 and the shelf lip 120, such that the gap spacer device 100, when installed, does not fall through the gap 18. Additionally, in another embodiment without departing from this invention, as illustrated in FIGS. 7 and 8, the shelf lip 120 may be continuous throughout the entire length of the gap spacer device 100.

As illustrated in FIGS. 2 and 3, the gap spacer device may include a plurality of teeth 130. The plurality of teeth 130 may project from the gap filler portion 104, extending upward and slightly towards the back or towards the pegboard 14 when installed. The teeth 130 may be spaced evenly from one end 102 to the other end 102 throughout the entire length of the gap spacer device 100. The teeth 130 may be flexible enough such that they are individually able to flex from side to side when a peg hook is mounted to the pegboard 14. The teeth 130 may also allow an electric cord to run to run through the back of the shelving system 10 and the gap spacer device 100. Additionally the teeth 130 may be flexible enough to bend such that the teeth 130 as a group may flex when installed onto the shelving system 10 based on the differing size of gaps and other factors. Any number of teeth 130, gap size between individual teeth 130, and differing lengths of teeth 130 may utilized without departing from the invention as long as the teeth are able to prevent the product 20 from sliding into the gap 18.

Figure 5:
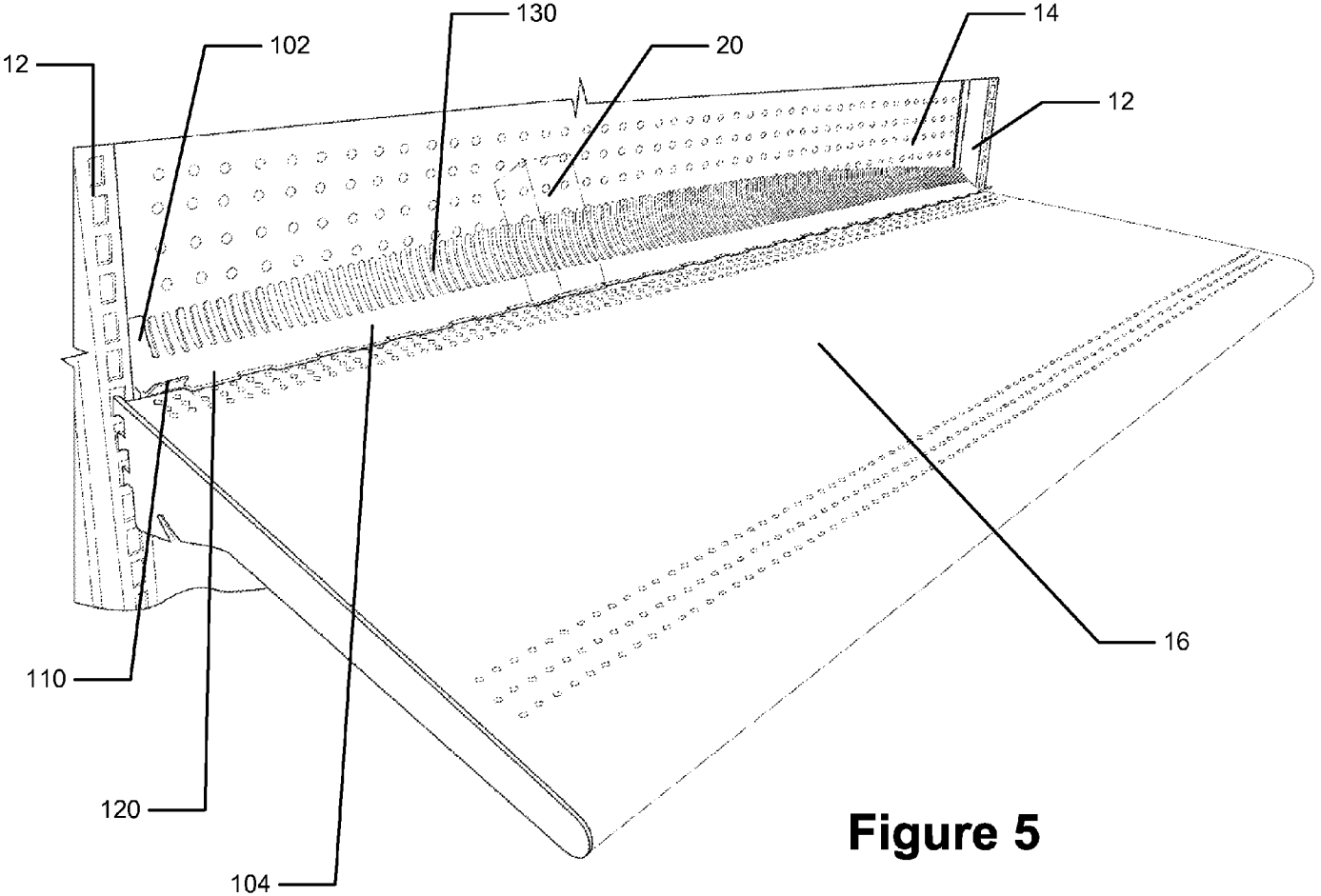
FIG. 5 shows a perspective view of the gap spacer device illustrated in FIG. 2 as installed in a shelving system.

In another embodiment of the present invention, the teeth 130 may be slightly longer towards the middle of the gap spacer device, thereby creating an upward bow effect in the middle of the gap spacer device 100. This upward bow 132 is illustrated in FIGS. 2 and 5. In some shelving systems 10, the shelf 16 sags because of the length and weight of the shelf 16, as well as lack of support in the middle of the shelf 16. When the shelf 16 sags, the gap filling device 100 will also sag, thereby lowering the teeth 130 on the back pegboard 14. When the shelf 16 sags, the teeth 130 with the upward bow 132 may continue to provide the required protection from the product 20 falling into the gap 18.

In another embodiment of the present invention, as illustrated in FIG. 2, the gap spacer device 100 may include one or more stability tabs 140. The stability tabs 140 may extend from a lower portion of the gap spacer device 100. The stability tabs 140 may be sized and shaped such that the stability tabs 140 engage the pegboard 14 to help keep the middle of the gap spacer device 100 stable and secure within the shelving system 10. The stability tabs 140 are especially important for longer length gap spacer devices 100. There may be one stability tab 140 near the middle of the gap spacer device 100, as illustrated in FIG. 2. Additionally, there may be more than one stability tab 140 located at various locations, ideally towards the middle of the gap spacer device 100, to help maintain the stability and security of the gap spacer device as installed on the shelving system 10.

Figure 4A:
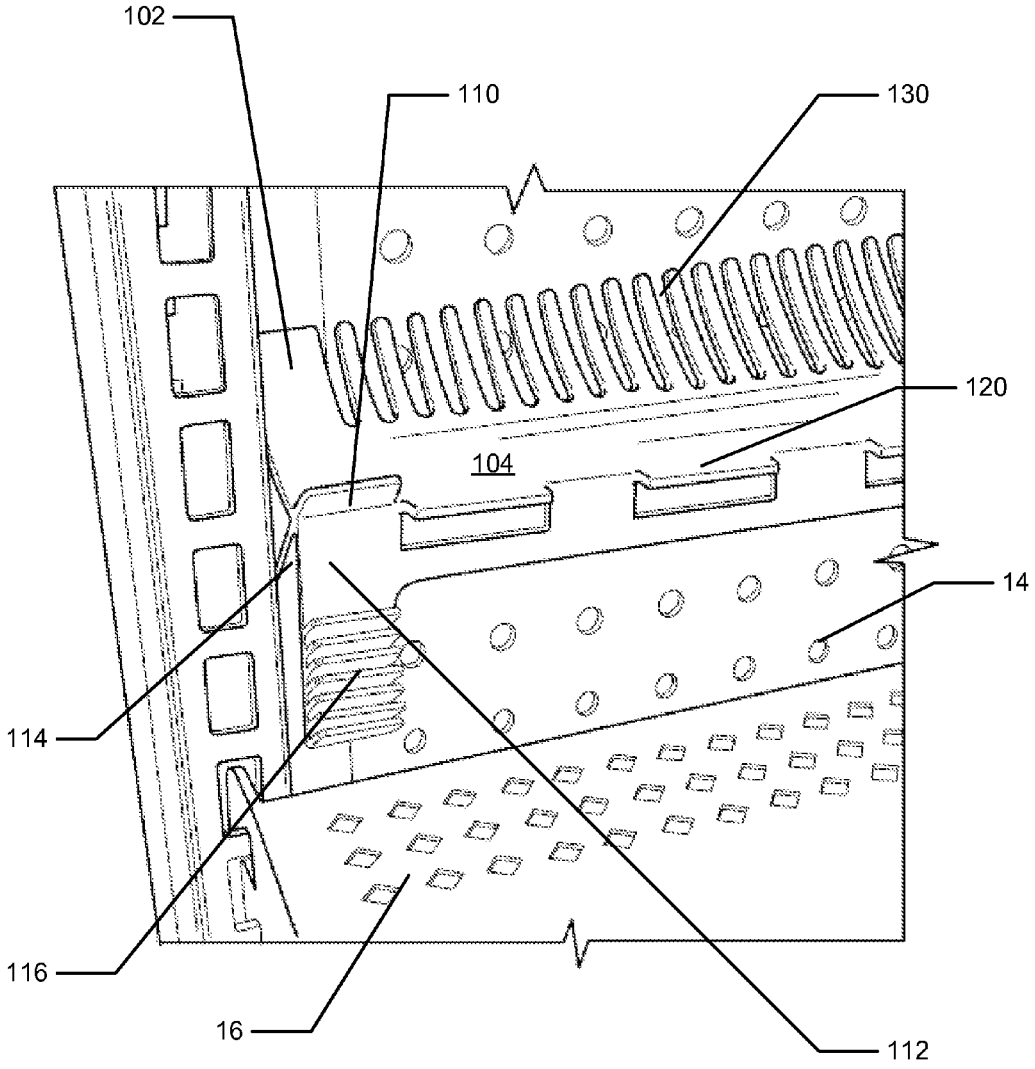
FIGS. 4A through 4C illustrate close-up perspective views of the installation of the gap spacer device shown in FIG. 2.
Figure 4B:
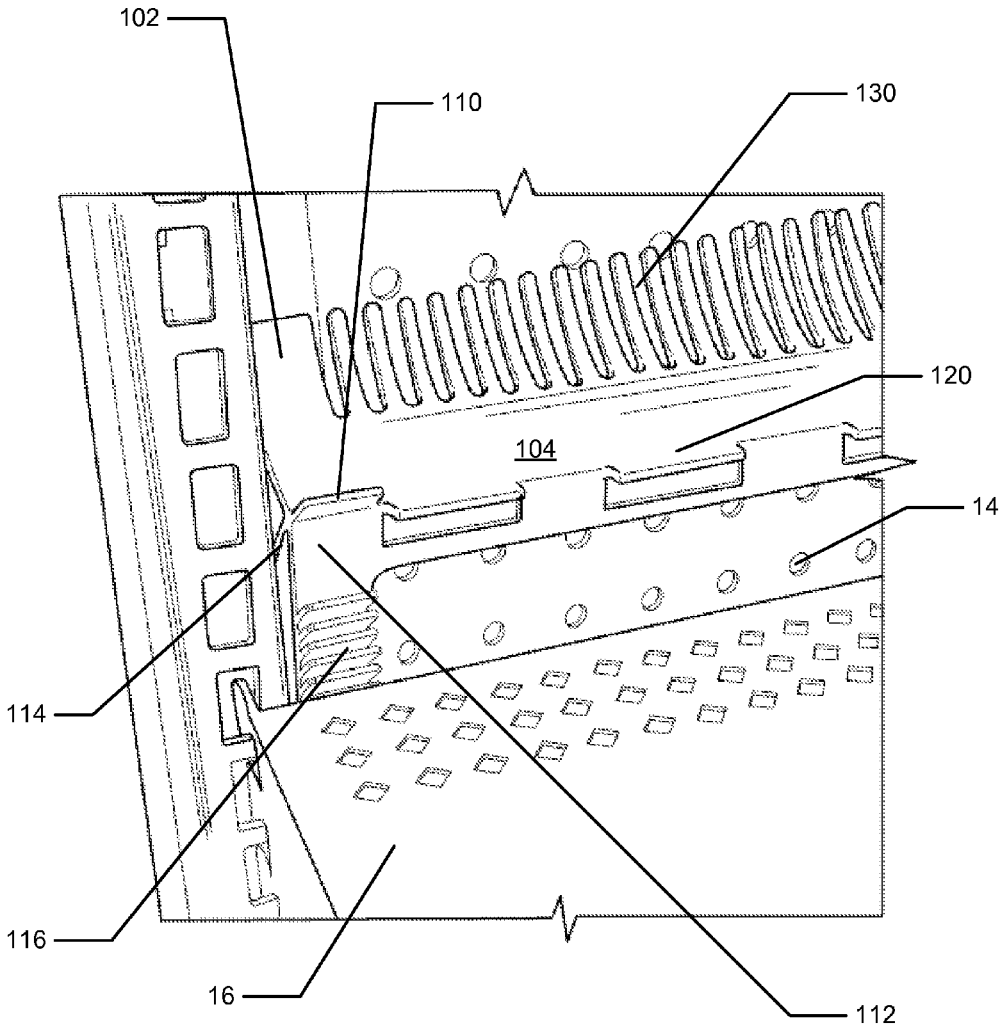
Figure 4C:
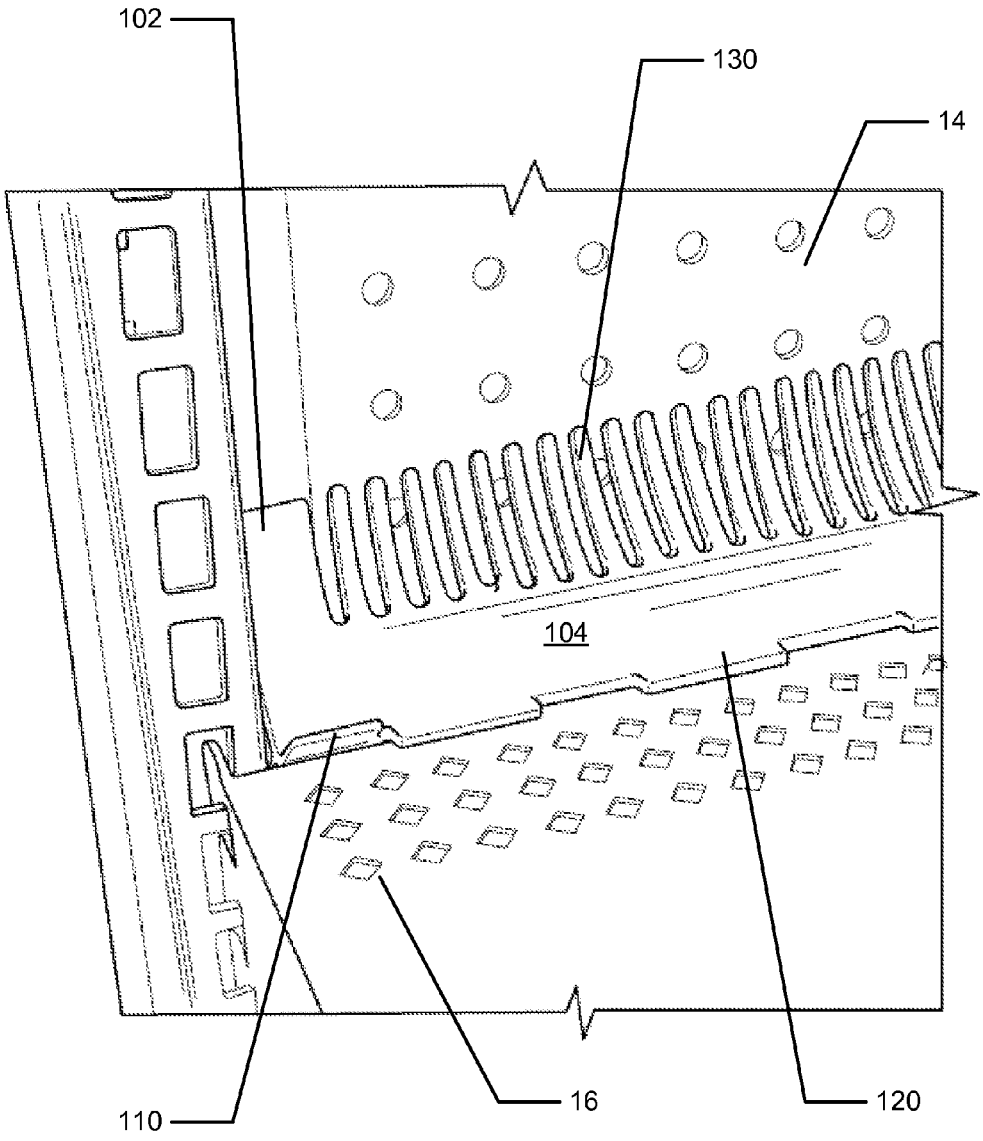
Figure 6:
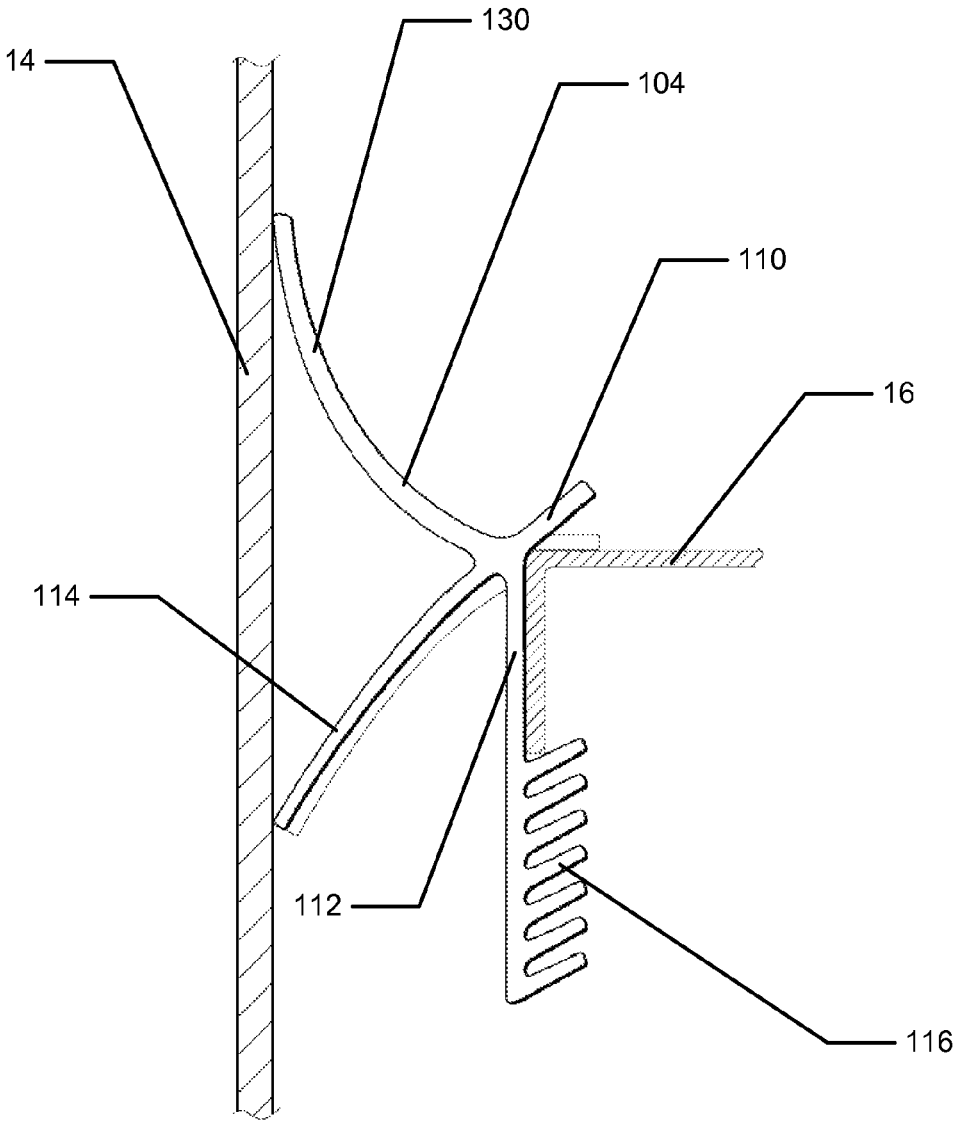
FIG. 6 shows a cut-away side view of the gap spacer device illustrated in FIG. 2 as installed in a shelving system.

FIGS. 4A through 4C illustrate the installation and removal of the gap spacer device 100 for the shelving system 10. To install the gap spacer device 100, a user would grasp the tabs 110 on each end 102 of the gap spacer device 100. As illustrated specifically in FIG. 4A, the user may then move the gap spacer device 100 to the pegboard 14 above the gap 18 and covering the entire length of the gap 18 and spanning the shelf 16. The user, still holding the gap spacer device 100 at the tabs 110, pushes the gap spacer device 100 towards the pegboard 14, thereby flexing the support arm 114 against the pegboard 14 or the uprights 12. The user pushes the gap spacer device 100 towards the pegboard until the mounting arm 112 is far enough back such that the flared projections 116 are able to slide into the gap 18. As illustrated in FIG. 4B, when the gap spacer device 100 is in position to be installed into the gap 18, the user then slides the gap spacer device 100 downward with the support arm 114 sliding against the back of the pegboard 14 or uprights 12 and the mounting arm 112 sliding into the gap 18. As the gap spacer device 100 is pushed downward into the gap, the flared projections may make a clicking noise as they slide past the back of the shelf 16. As illustrated in FIG. 4C, the user pushes the gap spacer device 100 downward until the shelf lip 120 is flush with the shelf 16. The mounting arm 112 and the one of the flared projections 116 will be locked into place and secured into the shelving system 10 against the back of the shelf 16. FIG. 6 illustrates a close-up view of the locking of the flared projections 116 against the back of the shelf 16.

As was discussed previously, the gap spacer device 100 will prevent and block product 20 from falling between the gap 18. Additionally, when the gap spacer device 100 is installed, as illustrated in FIG. 5, the plurality of teeth 130 provide a means for peg hooks to be mounted from the other side of the pegboard 14. When the peg hooks are mounted from the other side of the pegboard 14, the hooks may push through onto the pegboard 14 and the teeth 130 will flex around the peg hook as it protrudes through the pegboard 14, thereby allowing the peg hook and peg hole to be utilized without blocking it. Additionally, as was described earlier, if the shelf 16 sags, the upward bow 132 on the teeth 130 allows the shelf 16 to sag, while still providing the prevention and blockage of product in the gap 18.

The removal of the gap spacer device 100 is similar to the installation and mounting of the gap spacer device 100. Again, the user holds and handles the gap spacer device 100 using the tab 110. The user will first grasp each of the tabs 110 on each of the ends 102 of the gap spacer device 100. The user will then push the gap spacer device 100 inward towards the pegboard 14 and uprights 12. When the user pushes the gap spacer device 100 inward toward the pegboard 14 and uprights 12, the support arm 114 flexes against the pegboard 13. Additionally, the mounting arm 112 and flared projections 116 release and unlock from the locking configuration against the back of the shelf 16. After the mounting arm 112 and flared projections 116 have been released from the back of the shelf 16, the user may pull up on the tab 110 of the gap spacer device 100 thereby sliding the gap spacer device 100 out of the gap 18. As the user is pulling up on the tab 110, the user may have to maintain pressure against the back of the pegboard 14 and uprights 12 so that the support arm 114 remains flexed against the back of the pegboard 14. The user may then continue to pull up on the gap spacer device 100 until the gap spacer device 100 can be removed from the shelving system 10.

FIGS. 7 and 8 illustrate another embodiment of the gap spacer device 700 according to the present invention. The gap spacer device 700 may generally be the length of shelving system 10, spanning from one upright 12 to the other upright 12. The gap spacer device 700, when installed in the shelving system 10, will fill the gap 18 against the pegboard 14 and between the back of the shelf 16. The gap spacer device 700 may be constructed as a one-piece, molded plastic piece. Other suitable constructions and materials may be utilized without departing from this invention. Generally, the gap spacer device 700 includes two ends 702 and a gap filler portion 704 that spans between each of the two ends 702. The gap spacer device 700 will be described in more detail below.

As illustrated in FIG. 7, the gap spacer device 700 includes two ends 702. FIG. 8 illustrates a close-up version of one of the ends 702. As illustrated in FIGS. 7 and 8, each end 702 may include a tab 710, a mounting arm 712, and a support arm 714. The tab 710, the mounting arm 712, and the support arm 714 assist with and allow the gap spacer device 700 to be installed and secured to the shelving system 10.

As illustrated in FIGS. 7 and 8, the tab 710 is located at one or both of the ends 702 of the gap spacer device 700. The tab 710 may project outward and away from the gap spacer device 700 and the gap filler portion 704 and towards a user. The tab 710 may be sized such that a user can use their fingers to grasp onto the tab 710 when holding the gap spacer device 700, installing the gap spacer device 700, and/or removing the gap spacer device 700. The tab 710 may be rectangular as illustrated in FIG. 8 or other shapes without departing from this invention. The purpose of the tab 710 is to allow the user the ability to grasp and hold the gap spacer device 700 during installation and removal from the shelving system 10.

Similar to the mounting arm as illustrated in FIGS. 2 and 3 and described above, the mounting arm 712 is located at one or both of the ends 702 of the gap spacer device 700. Similar to the support arm as illustrated in FIGS. 2 and 3 and described above, the support arm 714 may be located at one or both of the ends 702 of the gap spacer device 700. The mounting arm 712 and the support arm 714 are the same as the description as described above and illustrated in FIGS. 2 and 3.

Additionally, the gap spacer device 700 may include a shelf lip 720. As illustrated in FIG. 7, the shelf lip 720 may project outward toward the user and away from the pegboard 14. The shelf lip 720 extends out such that the shelf lip 720 rests on or engages the top of the shelf edge 16 when the gap spacer device 700 is installed. As illustrated in FIG. 7, the shelf lip 720 may be continuous throughout the entire length of the gap spacer device 700. The shelf lip 720 may be any shape or size as long as the shelf lip 720 engages and maintains the gap spacer device 700 on the shelf 16. The purpose of the shelf lip 720 is to ensure the engagement of the shelf 16 and the shelf lip 720, such that the gap spacer device 700, when installed, does not fall through the gap 18.

As illustrated in FIGS. 7 and 8, the gap spacer device 700 may include an opening 730 between the two ends 702 of the gap spacer device 700. The opening 730 may be sized such that it allows a peg hook mounted to the pegboard 14.

The reader should understand that these specific examples are set forth merely to illustrate examples of the invention, and they should not be construed as limiting the invention. Many variations in the shelving systems and gap spacer devices may be made from the specific structures described above without departing from this invention.

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

I claim:

1. A device for use with a shelving system that defines a gap between a pegboard and a shelf, the device comprising:

two opposing ends, wherein each of the opposing ends includes a support arm and a mounting arm configured to extend downward towards the gap; and a gap filler portion extending between the two opposing ends and located between the two opposing ends, wherein the mounting arms are configured to engage a back of a shelf to secure and lock the device in the gap and the support arms are configured to flex against a pegboard providing biasing pressure against the pegboard, and wherein when the device is secured in the gap, the gap filler portion is configured to fill the gap.

2. The device of claim 1, wherein the mounting arms include flared projections configured to engage a back of the shelf to secure and lock the device in the gap.

3. The device of claim 1, wherein the gap filler portion includes a plurality of teeth extending upward and configured to engage with a pegboard.

4. The device of claim 3, wherein the plurality of teeth flex and are configured to receive a peg hook mounted on the pegboard.

5. The device of claim 1, wherein the gap filler portion includes an opening sized and configured to receive a peg hook mounted on a pegboard.

6. The device of claim 1, wherein each of the ends includes a tab that projects outward and away from the mounting arm.

7. The device of claim 6, wherein the tab is rectangular and sized such that a user can use their fingers to grasp the tab.

8. The device of claim 1, further including a shelf lip projecting outward from the gap filler portion toward the user and away from the pegboard, wherein the shelf lip is configured to engage a top of a shelf edge when the device is installed in a shelving system.

9. The device of claim 8, wherein the shelf lip is continuous throughout the length of the gap filler portion.

10. A shelving system for merchandise comprising:

a first upright and a second upright opposite the first upright;

at least one pegboard mounted to and between the first upright and the second upright;

at least one shelf mounted to the first upright and the second upright, thereby spanning the entire length of the pegboard between the first upright and the second upright, wherein the configuration includes a gap between a back of the shelf and the pegboard; and a gap spacer device extending between the first upright and the second upright, wherein when installed in the shelving system, the gap spacer device fills the gap and is configured to prevent or block merchandise from falling between the gap, wherein the gap spacer device comprises:

two opposing ends, wherein each of the opposing ends engage and mount between shelf and the pegboard, thereby locking the gap spacer device in the gap; and a gap filler portion extending between the two opposing ends and located between the two opposing ends, wherein when the gap spacer device is secured in the gap, the gap filler portion covers the gap.

11. The shelving system of claim 10, wherein the gap spacer device is constructed as a one-piece, molded plastic piece.

12. The shelving system of claim 10, wherein each of the two opposing ends include a support arm and a mounting arm, wherein the support arms extend downward towards the gap and flex against the pegboard providing biasing pressure against the pegboard and the mounting arms extend downwards towards the gap engaging the back of the shelf.

13. The shelving system of claim 12, wherein the mounting arms include flared projections that engage the back of the shelf to secure and lock the gap spacer device in the gap.

14. The shelving system of claim 10, wherein the gap filler portion includes a plurality of teeth extending upward and engaged with the pegboard, wherein the plurality of teeth flex and are configured to receive a peg hook mounted on the pegboard.

15. The shelving system of claim 10, wherein the gap spacer device includes one or more stability tabs that extend from a lower portion of the gap filler portion, wherein the stability tabs engage the pegboard to keep a middle of the gap spacer device stable and secure within the shelving system.

16. The shelving system of claim 10, wherein the gap spacer device includes a shelf lip projecting outward from the gap filler portion toward a user and away from the pegboard, wherein the shelf lip engages a top of the shelf when the device is installed in the shelving system.

17. A spacer device for use with a merchandise display that includes a first upright and a second upright opposite the first upright, a pegboard mounted to and between the first upright and the second upright, and at least one shelf mounted to the first upright and the second upright, thereby spanning the entire length of the pegboard between the first upright and the second upright, wherein the configuration includes a gap between a back of the shelf and the pegboard, the device comprising:

two opposing ends, wherein each of the opposing ends includes a support arm that extends downward towards the gap, a mounting arm that extends downward towards the gap, and a tab that projects outward and away from the mounting arm;

a gap filler portion extending between the two opposing ends and located between the two opposing ends;

a shelf lip projecting outward from the gap filler portion and away from the pegboard, wherein the shelf lip is configured to engage a top of a shelf edge when the device is installed in the merchandise display;

wherein the mounting arms include flared projections that are configured to engage a back of the shelf to secure and lock the device in the gap and the support arms are configured to flex against the pegboard providing biasing pressure against the pegboard, and wherein when the device is secured in the gap, the gap filler portion is configured to fill the gap.

18. The device of claim 17, wherein the gap filler portion includes a plurality of teeth extending upward and configured to engage with the pegboard.

19. The device of claim 17, wherein the shelf lip is continuous throughout the length of the gap filler portion.

20. The device of claim 17, wherein the shelf lip is non-continuous throughout the length of the gap filler portion.

* * * * *